United States Patent [19]

Cauffman

[11] Patent Number: 4,461,274

[45] Date of Patent: Jul. 24, 1984

[54] OUTDOOR FURNACE

[76] Inventor: Eugene W. Cauffman, Rte. 1, Trenton, Ky. 42286

[21] Appl. No.: 361,765

[22] Filed: Mar. 25, 1982

[51] Int. Cl.[3] ..... F24C 1/14

[52] U.S. Cl. ..... 126/77; 126/112; 126/163 R; 126/312

[58] Field of Search ..... 126/77, 163 R, 163 A, 126/292, 312, 307 A, 112, 15 R, 15 A, 146, 99 R, 193, 110 A, 110 E

[56] References Cited

U.S. PATENT DOCUMENTS

| | | | |
|---|---|---|---|
| 371,052 | 10/1887 | Fox | 126/312 |
| 712,377 | 10/1902 | Hemphill | 126/312 |
| 763,476 | 6/1904 | Garrison | 126/312 |
| 1,967,128 | 7/1934 | Moser | 126/312 |
| 2,016,869 | 10/1935 | McCrone | 126/163 R |
| 2,183,648 | 12/1939 | Johnson | 126/163 R |
| 2,417,138 | 3/1947 | Stenzy | 126/77 |
| 4,050,628 | 9/1977 | Konnerth | 126/312 |
| 4,140,101 | 2/1977 | Glover | 126/77 |
| 4,154,212 | 5/1979 | Wilkinson | 126/77 |
| 4,180,051 | 12/1979 | Maier | 126/77 |
| 4,201,185 | 5/1980 | Black | 126/15 R |
| 4,236,668 | 12/1980 | Prikkel | 126/292 |
| 4,319,556 | 3/1982 | Schwartz | 126/77 |
| 4,355,624 | 10/1982 | Hardin | 126/77 |
| 4,368,722 | 1/1983 | Lynch | 126/77 |
| 4,383,517 | 5/1983 | Gillis | 126/163 R |
| 4,404,956 | 9/1983 | Kutzner | 126/312 |

*Primary Examiner*—Daniel J. O'Connor

*Attorney, Agent, or Firm*—Harrington A. Lackey

[57] ABSTRACT

An outdoor furnace including a conditioned air chamber surrounding a fire box and having an air inlet and outlet connected to the space to be heated within the building. The furnace is characterized by a pre-heat chamber for the combustion inlet air as well as deflectors and baffles for maximizing contact of conditioned air flow over the fire box for maximizing the efficiency of the furnace. The furnace may also include an after-burner chamber and a damper for varying the degree of combustion within the after-burner chamber. The furnace also preferably includes an exhaust damper having a thermal control for exhausting excessively heated air from the conditioned chamber.

5 Claims, 6 Drawing Figures

10
14
15
16
18
19
21
22
24
25
26
28
37
38
47
58
63
64
68
69
70

10
14
15
18
19
20
21
22
27
30
31
32
34
35
36
39
40
41
42
52
54
56
57
58
61
62
68
71
75
78
79
80
83
84

OUTDOOR FURNACE

BACKGROUND OF THE INVENTION

This invention relates to a space heating system, and more particularly to an outdoor furnace connected to a building for heating a space within the building.

Furnaces of various types are well known in the art. Some outdoor furnaces are also known, such as those illustrated in the following U.S. Pat. Nos.:

| | | |
|---|---|---|
| 184,201 | Trench | Nov. 7, 1876 |
| 4,138,985 | Marley | Feb. 13, 1979 |
| 4,194,688 | Cobos | March 25, 1980 |

However, in each of the above patents, although the furnace is located outside of the structure to be heated, the only connection between the furnace and the heated structure is the hot air duct conducting heated air from the furnace into a space within the structure. However, the air to be heated is drawn into the furnace from the atmosphere, and therefore a complete circulation of conditioned air between the heated structure and the furnace is absent in each of the above three patents.

The Trench patent discloses a spiral flue around the combustion fuel chamber and the Marley patent discloses a baffle plate in the upper portion of a combustion chamber, for extending the heating path of the air. Nevertheless, none of the above patents disclose an outdoor furnace having the heat exchange structures which characterize the furnace made in accordance with this invention.

Other types of prior art furnaces are disclosed in the following U.S. Pat. Nos.:

| | | |
|---|---|---|
| 2,355,495 | Zier, Jr. | Aug. 8, 1944 |
| 2,703,567 | Manchester et al | March 8, 1955 |
| 2,879,762 | Robson | March 31, 1959 |
| 3,889,653 | Scogin | June 17, 1975 |
| 4,003,362 | Lener | Jan. 18, 1977 |
| 4,004,731 | Zung | Jan. 25, 1977 |

SUMMARY OF THE INVENTION

It is therefore an object of this invention to provide a uniquely constructed furnace for maximum efficiency, particularly adapted to be located outside of and connected to a building for heating a space within the building.

The furnace made in accordance with this invention includes a weatherproof housing completely enclosing a conditioned air chamber with well-insulated walls. The conditioned air chamber substantially completely encloses a fire box having a combustion chamber, a grate in the bottom of the combustion chamber, a solid fuel feed opening, and preferably including an after burner chamber above the combustion chamber. The conditioned air chamber has a hot air outlet and a cold air inlet connected to the space within the building to be heated. The hot and cold air ducting can be connected into corresponding duct work within the house, or it can be connected directly to the space to be heated.

The furnace made in accordance with this invention includes a pre-heat chamber located in front of the lower portion of the fire box just above the grate, and a blower for forcing combustion air from outside the housing into the pre-heat chamber and against a rearwardly declining baffle wall, which functions as a heat transfer medium between the pre-heat chamber and the fuel chamber above the grate. Thus, the inlet combustion air is pre-heated, while simultaneously cooling the baffle wall as the baffle wall deflects the pre-heated combustion air beneath, and upward through, the grate to supply the primary draft for burning the solid fuel within the fire box.

Preferably, elongated air flow passages are formed on both sides of the fire box within the conditioned air chamber by a plurality of vertically spaced elongated fins which are longitudinally offset to provide zig-zag or sinuous paths for the circulating air, thereby providing extended passages for the air to wipe the outer surface of the fire box to provide maximum heat transfer. The heated air is then transmitted across the very hot top of the after-burner chamber and thence through the hot air outlet to the conditioned space within the building.

A circulating fan is placed in the lower portion of the housing to blow air from the cold air inlet through an air inlet into the conditioned air chamber where the air is split or divided by a V-shaped deflector and flows evenly along both sides of the fire box. The heated air from both sides of the fire box then re-combines at the top of the conditioned air chamber for discharge through the hot air outlet.

The after-burner chamber is preferably provided with a front gas passage so that the products of combustion from the combustion chamber have to take a circuitous route forward and then upward and rearward through the after-burner chamber, flowing the entire length of the furnace in heat transfer relationship with the upper portion of the conditioned air chamber to transfer a maximum amount of heat from the products of combustion to the hot air chamber. The products of combustion, after passing through both the combustion chamber and the after-burner chamber, are discharged upward through the smoke stack to the atmosphere.

Preferably, the after-burner chamber is also provided with a rear gas passage adapted to be opened and closed by an adjustable damper, which is connected by a manually slidable operating rod extending through the front wall of the furnace.

The furnace made in accordance with this invention also preferably includes an exhaust port in the hot air outlet adapted to be normally closed by a hinged exhaust damper held in closed position by a fusible latch element responsive to a predetermined excess temperature causing the fusible latch element to release the damper and permit it to drop by gravity to exhaust hot air immediately to the atmosphere. The temperature-controlled exhaust damper is a safety feature for exhausting excessively heated air from the system in case of faulty or impaired circulation through the conditioned air chamber and ducts.

DESCRIPTION OF THE PREFERRED EMBODIMENTS

Figure 1:
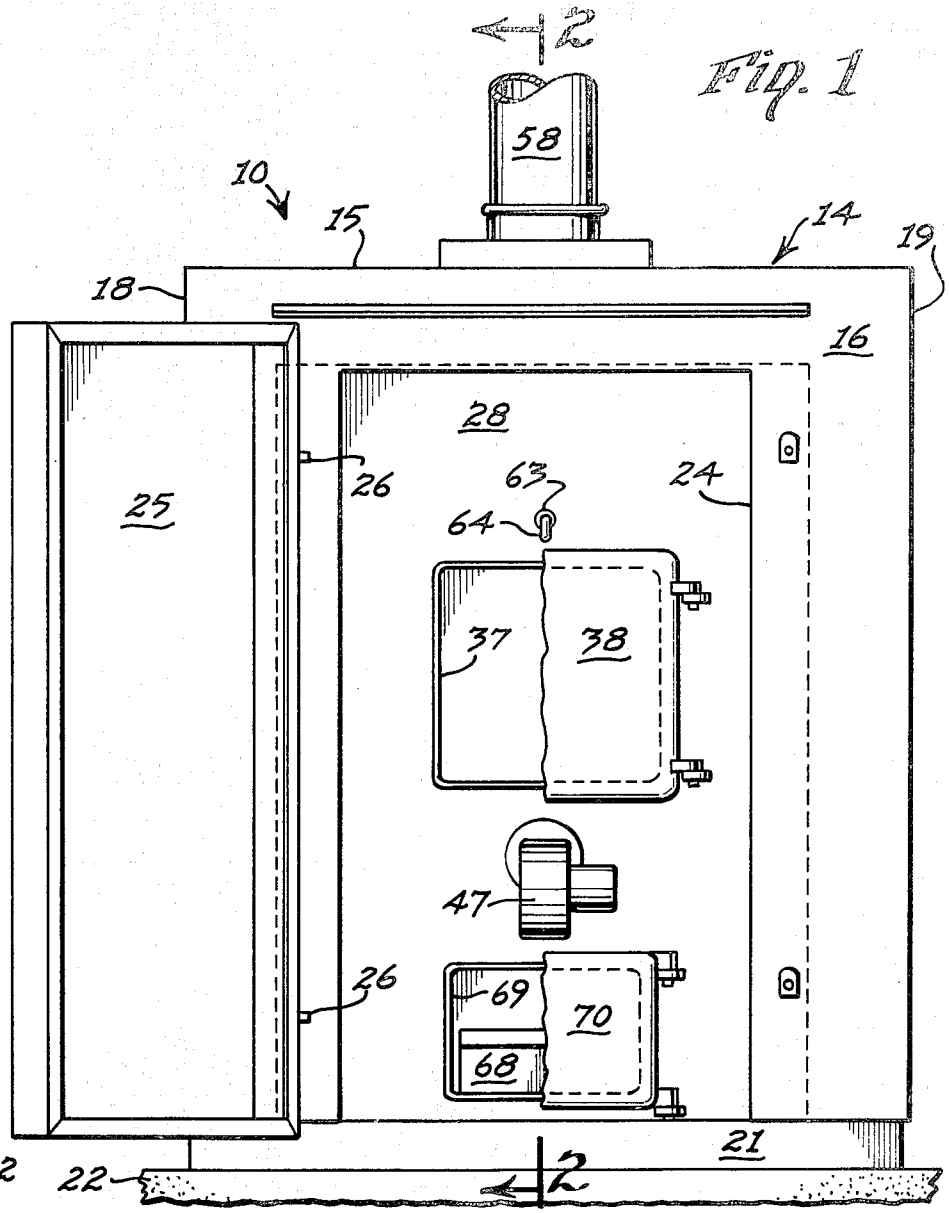
FIG. 1 is a front elevation of the furnace made in accordance with this invention, with the housing door open and the fuel door and ash door shown fragmentarily in closed positions.

Referring now to the drawings in more detail, the furnace 10 made in accordance with this invention is particularly adapted to be located outside and spaced from a building 11, the interior space 12 (FIG. 2) of which is desired to be heated.

The outdoor furnace 10 includes a weather-proof housing 14 having a top wall 15, a front wall 16, a rear wall 17, side walls 18 and 19 and a floor 20 having sills or beams 21 adapted to be mounted upon a rectangular concrete pad 22 laid on the ground adjacent to, but outside of, the building 11.

A large rectangular front access opening 24 is formed in the front wall 16 and adapted to be closed by a housing door 25 pivotally mounted upon the front wall 16 by the hinges 26.

Supported in substantially uniformly spaced relationship inwardly from the housing walls 15–19 are corresponding inner liner walls, specifically the top liner wall 27, the front liner wall 28, the rear liner wall 29, and the side liner walls 30 and 31. The spaces between the corresponding outer housing walls and the inner liner walls are filled with conventional insulating materials, such as fiberglass insulation batting 32.

These inner liner walls 27–31 define an insulated plenum or conditioned air chamber 34.

Mounted substantially entirely within the conditioned air chamber 34 is a fire box 35 including a combustion chamber 36 having a front fuel access opening 37 extending through the front wall 28 and adapted to be opened and closed by a hinged fuel access door 38.

The lower portion of the combustion chamber 36 comprises a fuel chamber 39 having a grate 40 separating the fuel chamber 39 from the lower ash pit 41. The fuel chamber 39 is lined with fire brick 42.

The front wall 44 of the fuel chamber 39 comprises a baffle wall 44 spaced rearward from the front wall 45 of the fire box 35 below the fuel access opening 36. The wall 45 constitutes the inner wall of a combustion air blower recess 46 receiving a combustion air blower 47 connected to a combustion air inlet 48 extending through the wall 45 into a pre-heat chamber 49 between the wall 45 and the baffle wall 44.

The air inlet 48 may be normally closed by a hinged vent flap or door 50 normally disposed in a closed position over the air inlet 48 by gravity, and being adapted to be opened by the force of the incoming air from the blower 47 through the air inlet 48. Thus, when the blower 47 is inoperative, undesirable incoming drafts and outgoing heated combustion air will be eliminated by the closed hinged door 50.

The air inlet 48 is located above the grate 40 and opposed to the baffle wall 44, which preferably declines rearwardly. Thus, incoming forced air from the blower 47 strikes the baffle wall 44 and is deflected downward by the baffle wall 44 to the ash pit 41. The deflected air is not only pre-heated by the baffle wall 44 within the pre-heat chamber 49, but also cools the fuel chamber 39. The pre-heated air is transmitted from the pre-heat chamber 49 beneath the grate 41 and then is drawn upward through the openings in the grate 40 to create a primary draft for the combustion of the solid fuel products within the fuel chamber 39 and the combustion chamber 36.

The products of combustion within the combustion chamber 36 are deflected by the upper baffle or partition wall 52 which defines an after-burner chamber 54 in the upper portion of the combustion chamber 36. Separating the front edge of the partition wall 52 from the front fire box wall 55 is a front gas passage 53 where the products of combustion enter the after-burner chamber 54. The after-burner chamber 54 extends substantially horizontally along the upper portion of the fire box 35 rearward substantially beyond the rear wall 56 of the fire box 35 where the after-burner chamber 54 communicates with an upward directed exhaust flue or flue pipe 57 and smokestack 58.

Preferably formed in the rear of the upper partition wall 52 is a rear gas passage 60 adapted to be closed and variably opened by a sliding damper 61. The damper 61 is connected to one end of an elongated operating rod 62 which extends forwardly through a guide sleeve 63 between the front walls 55 and 28. The handle 64 of the operating rod is manually accessible for forward and rearward movement when the front housing door 25 is open. When the housing door 25 is closed, the handle 64 and operating rod 63 are confined to their rearmost position to cause the damper 61 to close the rear gas passage 60.

Therefore, when the fuel is burning within the combustion chamber 36 and the doors 38 and 25 are closed, the products of combustion can pass only through the front gas passage 53 into the after-burner chamber 54 to provide the longest possible route for the products of combustion between the combustion chamber 36 and the smokestack 58. In this manner, the products of combustion will have an extended time for combustion, as well as an extended heat exchange surface for transmitting heat to the conditioned air space 34.

Formed transversely through the top portion of the inclined baffle wall 44 are a plurality of air ports 66 (FIGS. 2, 5, and 6) to permit some air from the pre-heat chamber 49 to enter the combustion chamber 36 over the burning fuel within the fuel chamber 39, thereby providing a secondary draft to assist in the combustion of the burning gases formed by the combustion of the solid fuel products.

An ash pan or drawer 68 is supported upon the floor 20 within the ash pit 41 and is adapted to be removed for emptying ashes received in the ash pan beneath the grate 40, through an ash access opening 69 adapted to be opened and closed by an ash door 70.

The furnace 10 made in accordance with this invention provides a completely closed air circulating system between the interior building space 12 and the conditioned air space 34 of the furnace 10. Cooler air is drawn from the conditioned space 12 through the cold air inlet duct 71 into the cold air plenum 72 in which is mounted a circulating fan 73. The circulating fan 73 located within the lower rear portion of the furnace 10, forces the cold air through an inlet opening 74 into the deflector chamber 76 of the conditioned air space 34. The air passing through the inlet 74 is divided by a V-shaped deflector 75 which distributes the air substantially evenly along both sides of the fire box 35.

The upper portion of the conditioned air chamber 34 is separated from the cold air plenum 72 and the deflector chamber 76 by a divider wall 77.

The incoming air is directed longitudinally forward along the opposite lower side walls of the fire box 56 by the outwardly laterally projecting lower fins 78. The front edges of the fins 78 terminate a spaced distance from the front of the fire box 35 to permit the air, which has wiped both outer surfaces of the fuel chamber 39 to rise above the fins 78 and then be directed rearwardly by the next higher, staggered pair of fins 79. As the heated air then moves rearwardly between the fins 78 and 79, some of the air heated by the side wall of the combustion chamber 36 will rise over the rear edges of the fins 79 for further heating, and some of the heated air will continue rearwardly past the fire box and around the lower extended portion 81 of the after-burner chamber 54, to receive additional heat before proceeding through the hot air duct 80 to the building space 12.

The rearward extending portion 81 of the after-burner chamber 54 is completely surrounded by the conditioned air space 34 so that the extended after-burner portion 81 gives up heat completely circumferentially from its outer surface to the conditioned air space 34. Moreover, some heat is picked up by the heated air within the conditioned air space as it passes around the exhaust flue 57.

Figure 3:
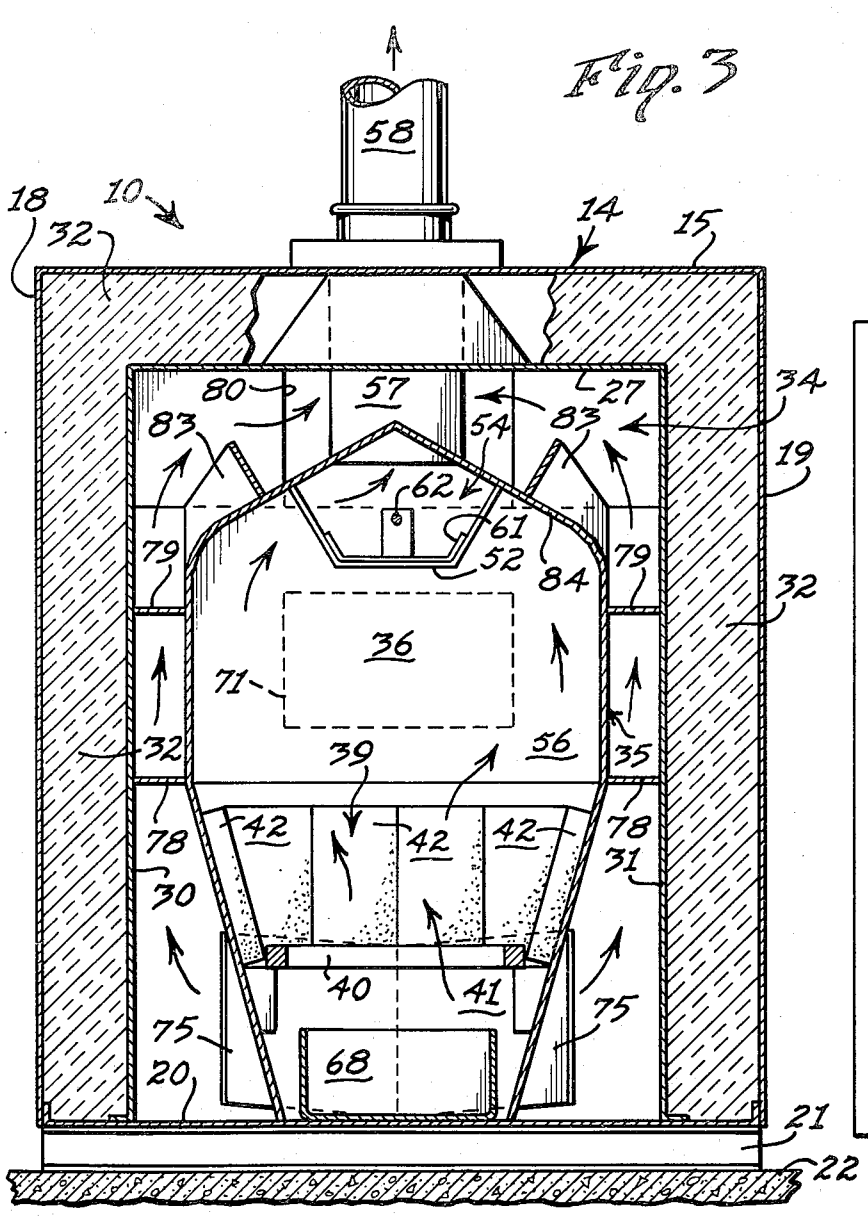
FIG. 3 is a section taken along the line 3—3 of FIG. 2.
Figure 5:
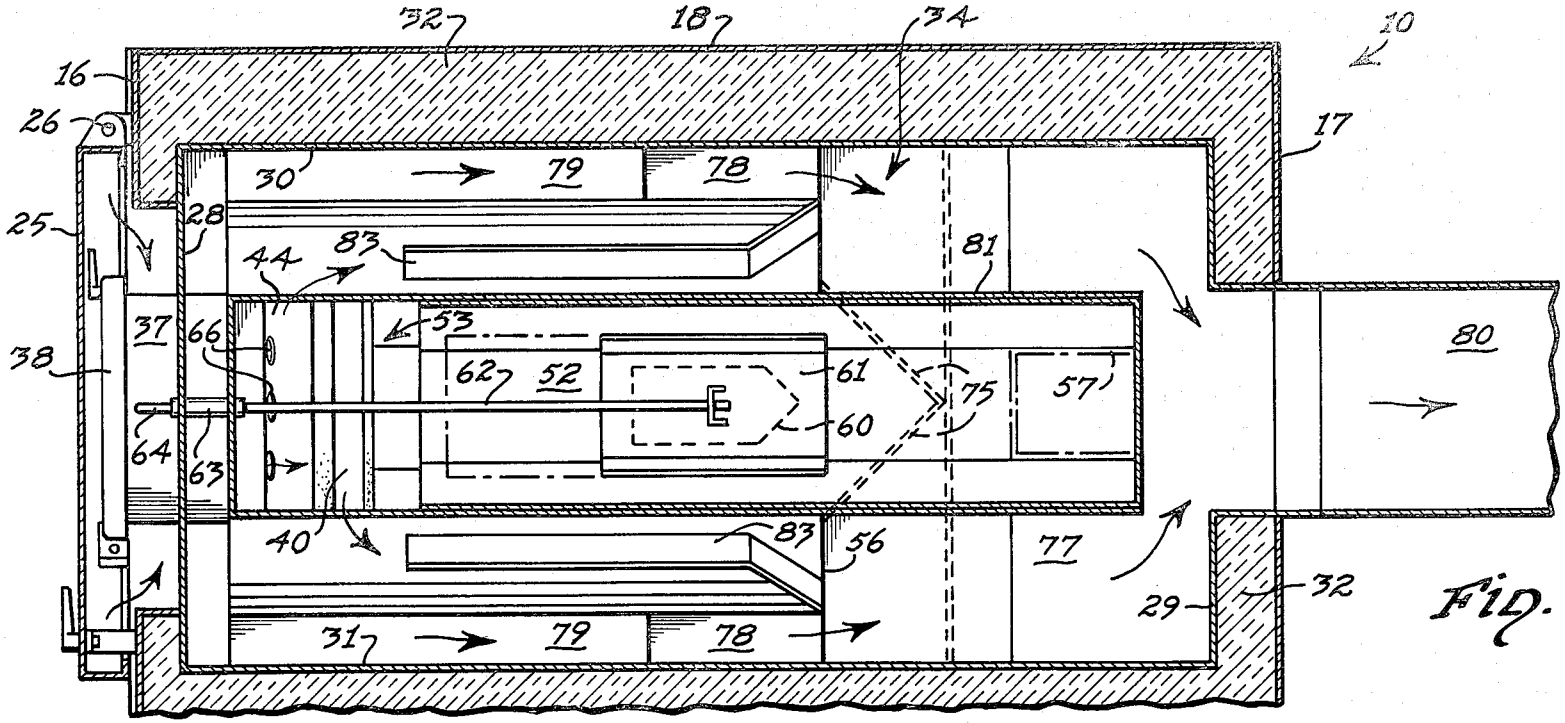
FIG. 5 is a section taken along the line 5—5 of FIG. 2.
Figure 6:
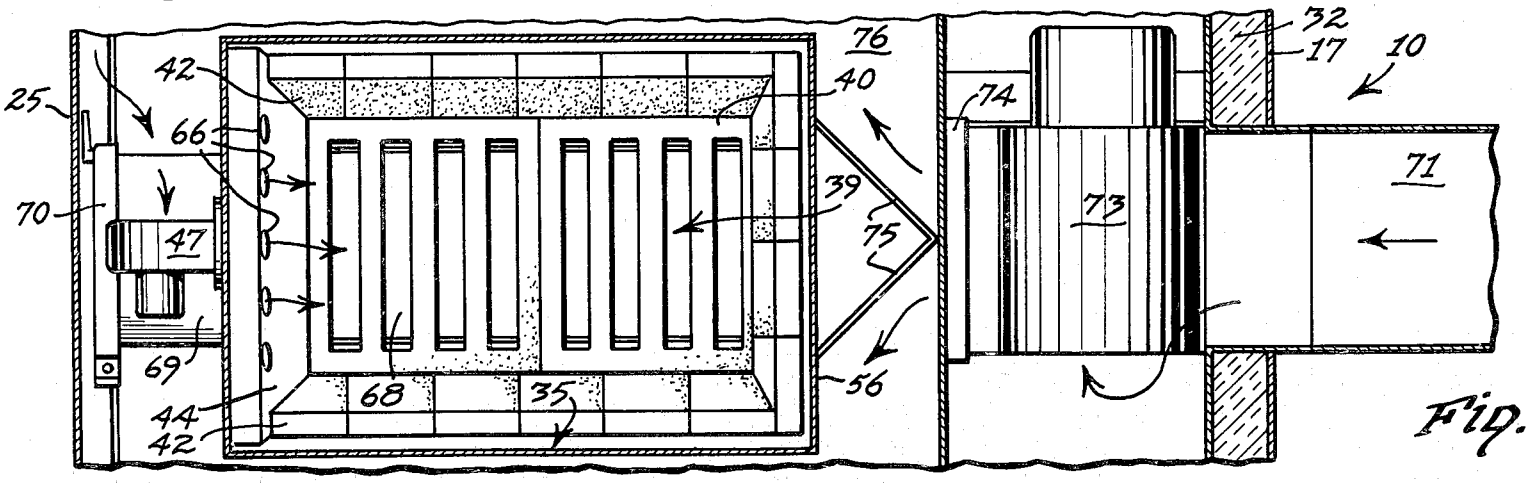
FIG. 6 is a fragmentary section taken along the line 6—6 of FIG. 2.

Upper baffles 83 may project outward from the top wall 84 of the combustion chamber 36, as best illustrated in FIGS. 3 and 5 to further direct the flow of air across the top of the after-burner chamber 54.

Furthermore, the fins 78, 79 and 83 conduct heat radially outward from the shell of the fire box 35 to provide more heat transfer surfaces to the air flowing over the fire box 35 in the conditioned air chamber 34.

Figures 2, 4:
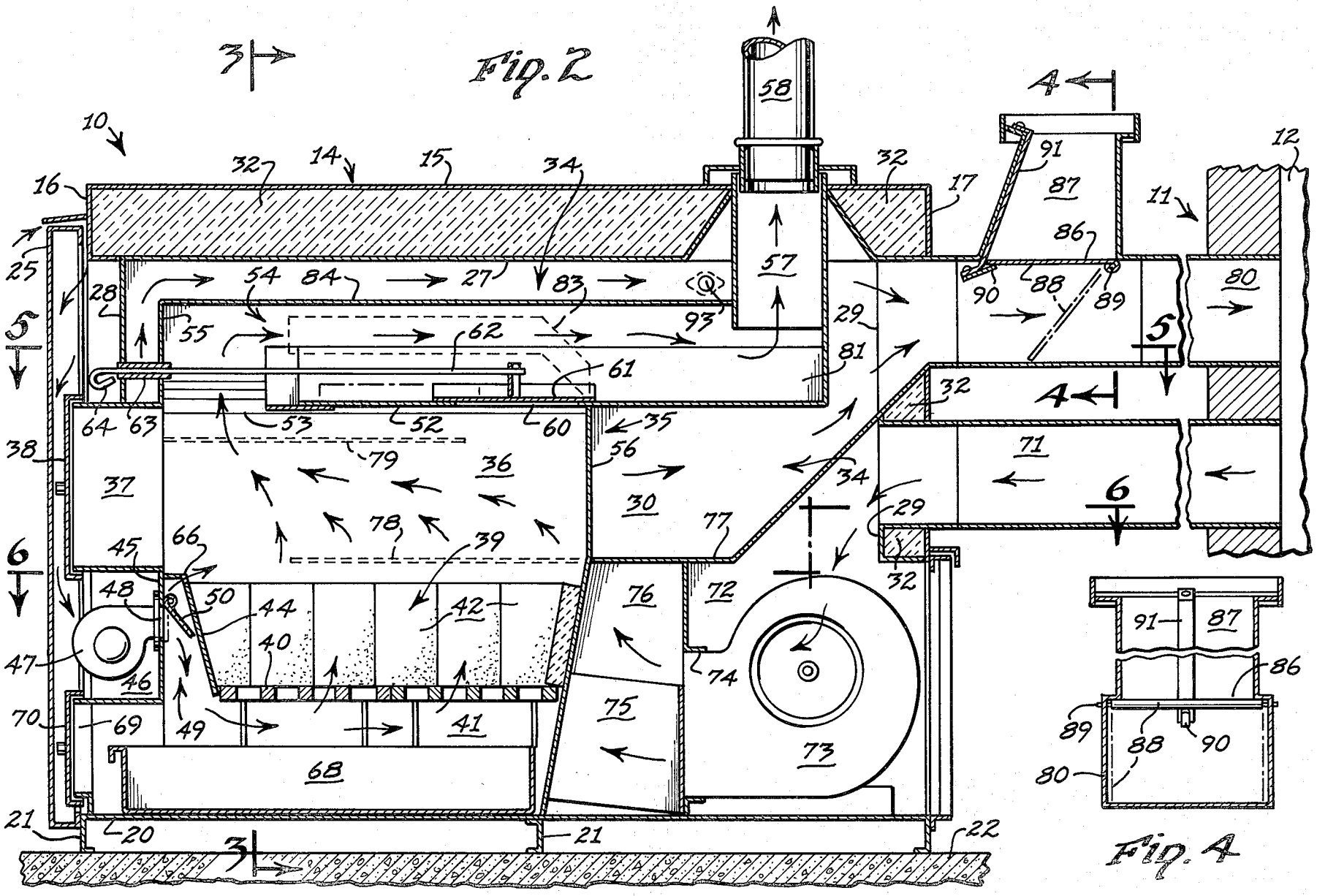
FIG. 2 is a section taken along the line 2—2 of FIG. 1, with the housing door closed.
FIG. 4 is a section taken along the line 4—4 of FIG. 2, illustrating the exhaust damper in solid-line closed position.

In the portion of the hot air duct 80 behind the rear wall 17 of the furnace 10 is a hot air exhaust port 86 communicating through an exhaust conduit 87 to the atmosphere (FIGS. 2 and 4). The exhaust port 86 is adapted to be normally closed by an exhaust damper or door 88 hinged to the duct 80 by a hinge 89. The free edge of the damper 88 is supported in closed position by a latch element 90 made of a fusible material, such as lead, which is fixed to a latch bracket 91 mounted in the conduit 87, as best disclosed in FIGS. 2 and 4.

When the air within the duct 80 becomes excessively hot, such as from a malfunction in the circulating fan 73 or a blockage in the duct 80 between the building 11 and the furnace 14, the excessive heat will cause the fusible latch element 90 to deflect or bend to release the free edge of the damper 80. The damper 80 will drop by gravity to its phantom position in FIG. 2 and thereby permit the exhaustion of the excessively hot air to the atmosphere through the conduit 87. In the preferred form of the invention, the damper 88 will drop to a position closing the duct 80 between the exhaust opening 86 and the building 11, to deflect all of the hot air through the conduit 87 to the atmosphere.

A temperature-responsive element 93 may be mounted in the conditioned air chamber 34 adjacent the exhaust flue 57, as illustrated in FIG. 2, to actuate a limit switch, not shown, to control the circulating fan 73 and operate the circulating fan 73 between high and low temperature settings, in a conventional manner. The limit switch may also be set to turn off the combustion air blower 47 when excessive temperatures are reached. Normally, the combustion air circulating blower 47 will be controlled by a thermostat within the building space 12.

The furnace 10 is designed for burning solid fuels, such as wood or coal, which can be introduced through the fuel opening 37, when the fuel access door 38 and the housing door 25 are open.

The damper 61 is adapted to be opened manually by the operating rod 62 when the housing door 25 is opened. Thus, when the doors 25 and 38 are open and the operator is introducing solid fuel through the opening 37 into the fuel chamber 39, when the residual fuel is still burning, the operator first grasps the handle 64 and pulls the damper 61 forward to open the rear gas passage 60, thereby permitting the products of combustion to discharge directly from the rear part of the combustion chamber 36 to the stack 58. This opening of the rear gas passage 60 minimizes any possibility of flame discharge through the access opening 37 which might injure the operator.

If desired, the operator rod 62 could be extended through a portion of the front wall 16 by appropriate linkages so that the damper 61 could be variably controlled from the outside even when all the doors are closed in order to direct more or less of the combustion products from the combustion chamber 36 through either the front gas passage 53 or the rear gas passage 60.

The furnace 10, because of the above described features, is particularly adapted for efficient burning of solid fuels to provide maximum heat for a building space 12. Numerous heat exchange surfaces are provided, not only for pre-heating the combustion air, but also for continually and extensively transferring heat from the walls of the fire box 35, the after-burner chamber 54 and 81, and exhaust flue 57, to the conditioned air space 34.

What is claimed is:

1. A furnace adapted to furnish warm air to a building space, comprising:

(a) a housing having enclosure walls, (b) a conditioned air chamber within said housing having a cold air inlet and a hot air outlet for fluid communication with the building space, (c) a fire box having front, rear, and opposed side walls, a top wall, and a lower portion, within said conditioned air chamber, (d) a combustion chamber within said fire box having a solid-fuel opening in said front wall, (e) a grate in the lower portion of said fire box, (f) an ash pit in said fire box below said grate and having an ash access opening, (g) a smokestack communicating with the upper portion of said combustion chamber and extending through an enclosure wall of said housing, (h) a baffle wall in heat transfer relation with the lower portion of said combustion chamber and having an outer surface, (i) a combustion air inlet extending through an enclosure wall of said housing and spaced from said baffle wall to permit air from outside said housing to be directed through said combustion air inlet, beneath said grate and into said combustion chamber, (j) a combustion air blower mounted on said enclosure wall in fluid communication with said combustion air inlet, for directing air through said combustion air inlet into said combustion chamber, (k) a vent door, (l) hinge means mounting said vent door across said combustion air inlet whereby said vent door is normally closed over said combustion air inlet, when said blower is inoperative, said vent door being adapted to be opened by the force of air from said combustion air blower through said combustion air inlet when said blower is operative.

2. The invention according to claim 1 further comprising a pre-heat chamber between said baffle wall and said combustion air inlet, said vent door being disposed within said pre-heat chamber.

3. The invention according to claim 1 further comprising an after-burner chamber having front and rear portions above said combustion chamber, a front gas passage in fluid communication between the front portion of said after-burner chamber and said combustion chamber, said rear portion of said after-burner chamber extending rearward from said fire box and communicating with said smokestack.

4. The invention according to claim 3 further comprising an exhaust port in said hot air outlet, an exhaust damper movable between a position closing said exhaust port and a position opening said exhaust port, and temperature-responsive latch means for holding said exhaust damper in said closed position, said temperature-responsive latch means being adapted to unlatch said exhaust damper upon actuation by a predetermined excessive temperature to open said exhaust port to permit the discharge of hot air from said hot air outlet through said exhaust port.

5. The invention according to claim 4 in which said exhaust damper is adapted to swing from a position closing said exhaust port to a position closing said hot air outlet, upon actuation of said temperature-responsive latch means.

* * * * *